US006041555A

United States Patent [19]

Alpi

[11] Patent Number: 6,041,555

[45] Date of Patent: Mar. 28, 2000

[54] INTEGRATED CORNER PIECE LEADER

[76] Inventor: George M. Alpi, 40 Philip Walk, West Babylon, N.Y. 11704

[21] Appl. No.: 08/859,178

[22] Filed: May 20, 1997

[51] Int. Cl.[7] ..... E04D 13/00

[52] U.S. Cl. ..... 52/11; 52/288.1; 52/287.1

[58] Field of Search ..... 52/16, 11, 287.1, 52/288.1

[56] References Cited

U.S. PATENT DOCUMENTS

| | | | |
|---|---|---|---|
| 3,500,600 | 3/1970 | Bagley, Sr. | 52/288.1 X |
| 4,104,839 | 8/1978 | Balzer et al. | 52/288.1 |
| 4,319,439 | 3/1982 | Gussow | 52/288.1 |
| 4,999,961 | 3/1991 | McNary | 52/287.1 |
| 5,526,612 | 6/1996 | Wade | 52/11 X |

*Primary Examiner*—Creighton Smith

*Attorney, Agent, or Firm*—Collard & Roe, P.C.

[57] ABSTRACT

A device for receiving run-off from gutters, comprising an elongated corner member with an L-shaped cross section for mounting along a corner of a house and an elongated hollow leader member having a generally L-shaped cross section. The corner member is mounted so that its edges lie beneath the siding of the house. The leader member is mounted on the corner member and runs vertically up the corner of the house and extends out only slightly from the siding of the house. The device also comprises a hollow upper elbow mounted on the upper portion of the leader member and extending upward and away from the leader member at an angle for connection with a gutter mounted to the edge of a roof of a house. A hollow lower elbow is mounted on the lower end of the leader member and extends downward and away from the leader member at angle. When the device is mounted on a house, run-off from the gutter flows into the upper elbow, through the leader member and out of the lower elbow and away from the house.

5 Claims, 2 Drawing Sheets

INTEGRATED CORNER PIECE LEADER

BACKGROUND OF THE INVENTION

1. Field of the Invention

This invention relates to a device for receiving run-off from gutters mounted along the edges of a roof. In particular, this invention relates to a device that functions as the corner piece of a house as well as a run-off for gutters.

2. Prior Art

Leaders for gutters are commonly used to receive gutter run-off and direct the run-off away from a house, to avoid soaking the ground surrounding a house and prevent flooding in the basements. A typical leader consists of an aluminum tube that is attached to the end of a gutter and runs vertically along the side of a house, usually at a corner. The bottom of the leader extends outward at the bottom so that the run-off does not seep into the ground immediately adjacent to the house.

The commonly-used leader suffers from many drawbacks. First, the aluminum tubing is prone to dents and rusting, thus decreasing the effectiveness of the leader as well as its appearance. Second, the prior art leader extends outwardly from a house and is obtrusive and unattractive.

SUMMARY OF THE INVENTION

It is therefore an object of the present invention to provide a leader that is durable and efficient.

It is another object of the present invention to provide a leader that is integral with the siding of a house and is unobtrusive and attractive.

It is yet another object of the present invention to provide a leader that is simple and inexpensive to manufacture.

The invention comprises a corner-piece leader for a gutter comprising a longitudinally extending corner member having an L-shaped cross section and a hollow leader member having a generally L-shaped cross section. The corner member is mounted on the corner of a house so that the longitudinal ends of the corner member are mounted beneath the siding of a house. The leader member is mounted on the corner member and follows the contours of the corner of the house. The shape of the leader member is such that it can accommodate a significant volume of water and debris without substantially protruding from the house.

The invention further comprises an upwardly extending hollow upper elbow attached at one end to an upper portion of the leader member and extending through an aperture in the leader member. The other end of the upper elbow is connected to a gutter mounted on the edge of a roof.

The invention also comprises an outwardly extending lower elbow mounted on the bottom of the leader member, to direct the run-off away from the house. This way, run-off from the gutter travels through the elbow and down into the leader member and out the lower elbow.

Preferably, the invention is made from heavy gauge vinyl, that is contoured and dyed to match the siding of the house on which it is to be mounted. This way, the invention blends in with the house's natural siding and does not interfere with its aesthetic appearance. The invention can also be manufactured so that the leader member is detachable from the corner member, for ease of replacement, cleaning or repair.

DETAILED DESCRIPTION OF THE PREFERRED EMBODIMENT

Figure 1:
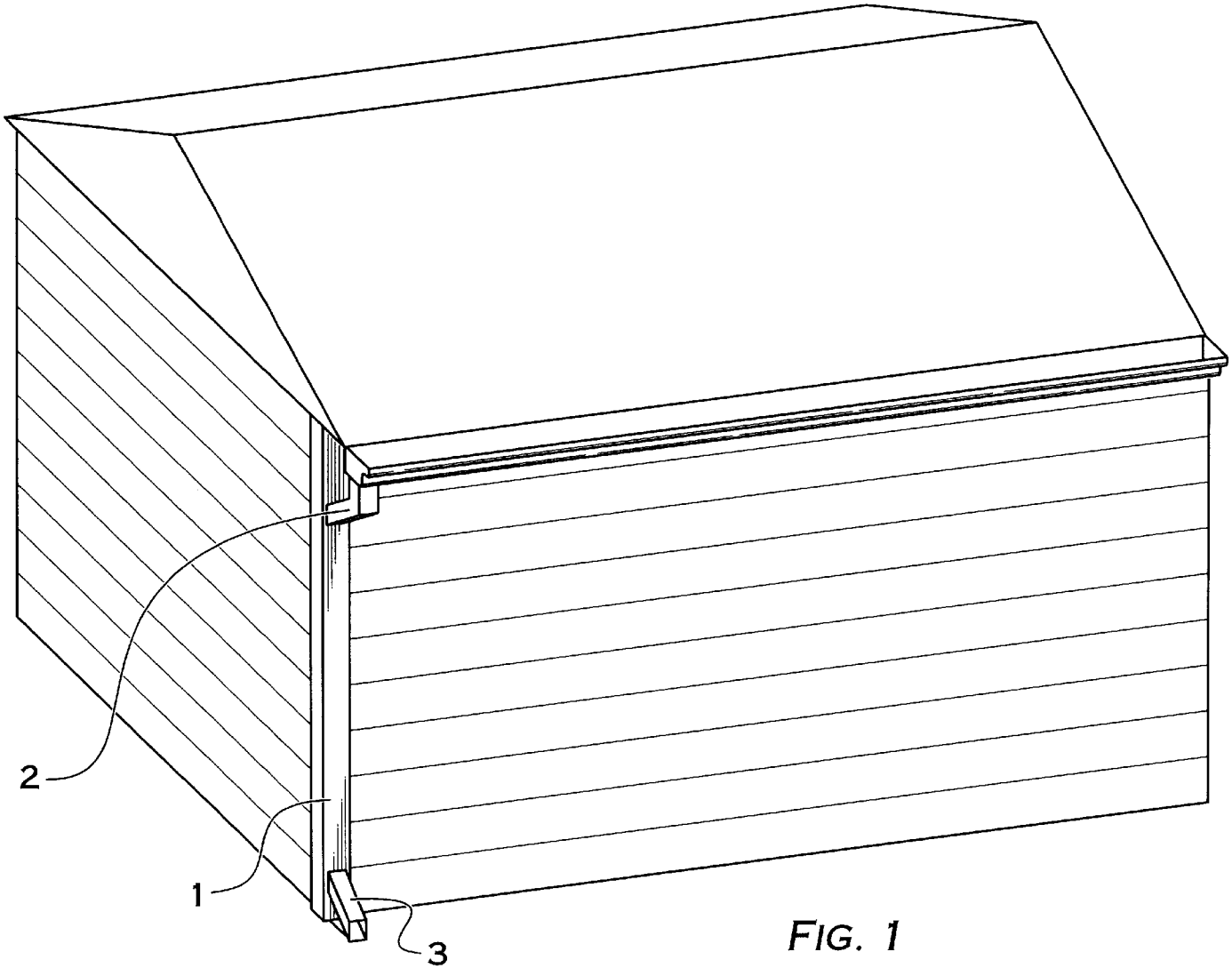
FIG. 1 is a perspective view of a corner of a house with the present invention mounted thereon.

Turning now in detail to the drawings, and in particular FIG. 1, there is shown a corner of a house with the present invention mounted thereon. Leader means 1 is shown running along the corner of the house. Upper elbow 2 is connected to leader means 1 on one side near the upper end and extends to the edge of the roof where it connects with gutter 20. Lower elbow 3 is attached to the same side of leader means 1 as upper elbow 2 and extends outward and downward from leader means 1. Water and debris from gutter 20 flow through upper elbow 2, through leader means 1 and out lower elbow 3.

Figure 2:
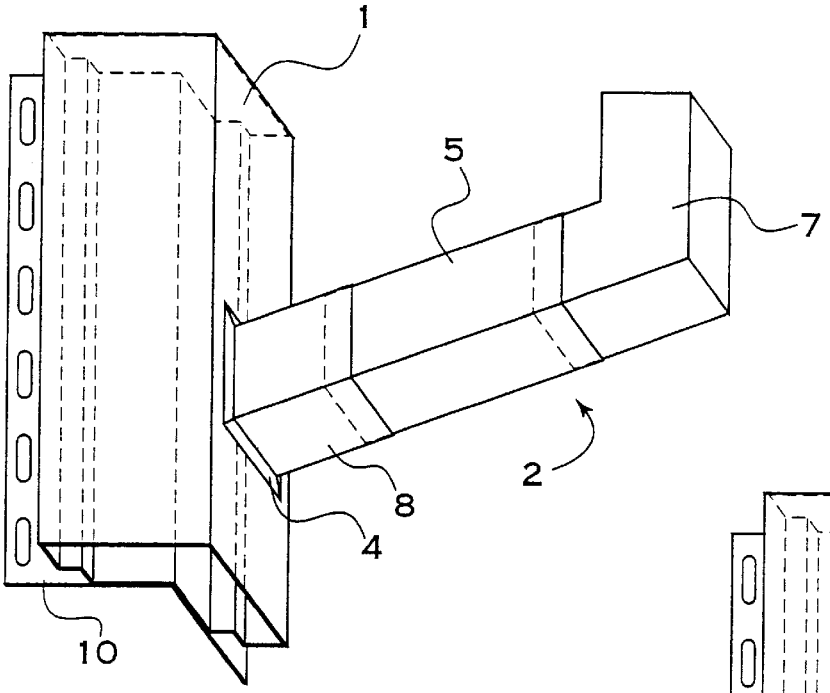
FIG. 2 is a perspective view of the upper section of the present invention.

FIG. 2 shows an enlarged perspective view of the upper elbow as it is connected to leader means 1. Upper elbow 3 comprises a sleeve 8 which is mounted to the side of leader means 1 via a flanged end 4. Flanged end 4 can be attached to leader means 1 by way of bolts, screws or any other suitable means. A tube 5, which fits securely within sleeve 8 and which extends through into the interior of leader means 1. Elbow section 7 is inserted into the other end of tube 5 and connects upper elbow 2 to a mounted gutter. Tube 5 can be cut to length when mounted on a house so that upper elbow 2 exactly fits between leader means 1 and gutter 2. Sleeve 8, tube 5 and elbow section 7 come as separate pieces that can be assembled after tube 5 is cut to the proper size.

Figure 3:
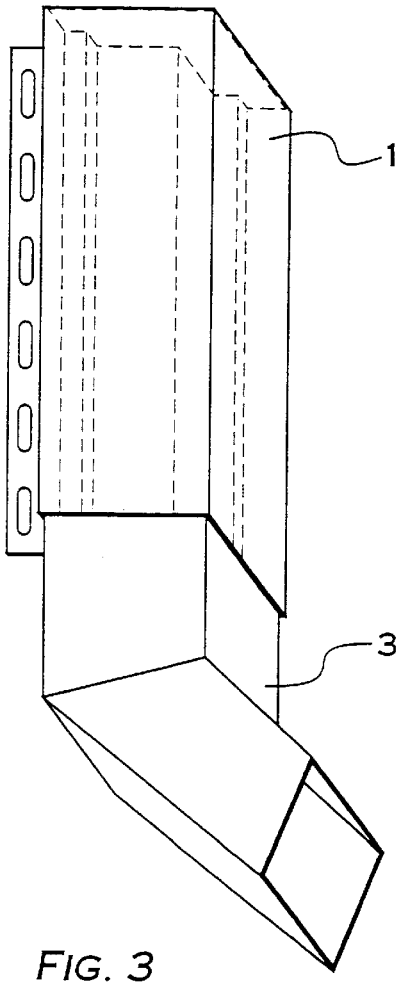
FIG. 3 is a perspective view of the lower section of the present invention.

FIG. 3 shows an enlarged view of the leader member as it is attached to lower elbow 3. Lower elbow 3 slides within the bottom of leader member 1 and fits snugly within leader member 1. Lower elbow 3 can be attached to leader member 1 and via any suitable means, such as screws, or bolts, which can be positioned at any desired height. This arrangement enables lower elbow 3 to be precisely positioned on leader member 1 so that the proper height of the opening through which the gutter runoff flows, is achieved.

Figure 4:
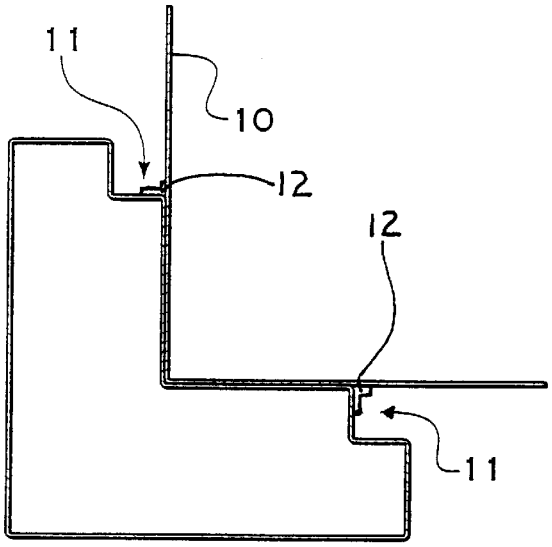
FIG. 4 is a cross sectional view of the leader means of the present invention.

FIG. 4 shows a cross-section of leader member 1 as it is mounted on corner piece 10. Corner piece 10 is used to mount the leader assembly to a corner of a house. Leader member 1 has a substantially L-shaped cross section that fits snugly on the apex of corner member 10. Preferably, leader member 1 contains grooves 11, which, when the corner piece is mounted to the leader member, form slots for receiving the siding panels of the house. Leader member 1 is attached to corner piece 10 by a plurality of releasable latches 12. Corner member 10 is preferably mounted underneath the siding of the house, and the siding panels are then inserted into grooves 11. This way, leader member 1 appears to form an integral part of the siding of a house and does not protrude outward extensively from the house, but yet maintains a sufficiently large cross section to accommodate a large volume of gutter run-off.

While several embodiments of the present invention have been shown and described, it is to be understood that many changes and modifications may be made thereunto without departing from the spirit and scope of the invention as defined in the appended claims.

What is claimed is:

1. A device for receiving run-off from gutters, comprising:

an elongated corner member adapted for mounting along a corner of a house and having a generally L-shaped cross section, two longitudinal edges, an interior face and an exterior face, wherein each longitudinal edge is adapted for mounting beneath siding on a house;

an elongated hollow leader member having a generally L-shaped cross section, an interior face, an exterior face, an upper end and a lower end, the interior face of the leader member being mounted to the exterior face of the corner member, wherein the exterior face of the hollow leader extends only slightly outward from the siding of the house;

an aperture on the exterior face of the leader member near its upper end;

a hollow upper elbow mounted in the aperture of the leader member, said upper elbow extending upward and away from the leader member at an angle and adapted to connect with a gutter mounted to the edge of a roof of a house;

a hollow lower elbow having an upper end and a lower end, said upper end being mounted on the lower end of the leader member, said lower elbow extending downward and away from the leader member at an angle, wherein run-off from the gutter flows into the upper elbow, through the leader member and out of the lower elbow and away from the house.

2. The device according to claim 1, wherein the device is made of vinyl.

3. The device according to claim 1, wherein the leader member is releasably attached to the corner member by means of releasable latches.

4. The device according to claim 1, wherein the upper elbow comprises:

a sleeve mounted on the leader member;

a straight hollow tube having a first end and a second end, said first end slidably mounted within the sleeve, wherein said hollow tube is cut to any desired length; and a hollow elbow having a first end and a second end, the first end of said elbow being mounted within the second end of the tube, and a second end of said elbow being adapted for attachment to a gutter.

5. A device according to claim 1, wherein the upper end of the lower elbow is slidably mounted within the lower end of the leader member and is secured to the leader member by fasteners selected from the group consisting of bolts and screws.

* * * * *